US007688008B2

(12) United States Patent
Uchida et al.

(10) Patent No.: US 7,688,008 B2
(45) Date of Patent: Mar. 30, 2010

(54) LIGHTING LAMP

(75) Inventors: Daisuke Uchida, Tokyo (JP); Osamu Miyata, Tokyo (JP); Toshiyuki Kondo, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 11/562,476

(22) Filed: Nov. 22, 2006

(65) Prior Publication Data

US 2007/0120507 A1 May 31, 2007

(30) Foreign Application Priority Data

Nov. 25, 2005 (JP) ..... 2005-340309

(51) Int. Cl.
*H05B 37/02* (2006.01)

(52) U.S. Cl. ..... 315/360; 315/77; 315/185 R; 315/224

(58) Field of Classification Search ..... 315/209 R, 315/224–226, 246, 291, 307, 312, 362, 77, 315/82, 360
See application file for complete search history.

(56) References Cited

U.S. PATENT DOCUMENTS 5,821,697 A * 10/1998 Weber ..... 315/200 A
6,239,716 B1 * 5/2001 Pross et al. ..... 340/815.4
6,396,466 B1 * 5/2002 Pross et al. ..... 345/82
6,933,684 B2 * 8/2005 Yang et al. ..... 315/274
2005/0122064 A1 * 6/2005 Chevalier et al. ..... 315/291
2005/0179393 A1 * 8/2005 Murakami et al. ..... 315/77
2005/0206589 A1 * 9/2005 Miyachi et al. ..... 345/73
2006/0022607 A1 * 2/2006 Hsu ..... 315/209 R
2006/0098440 A1 * 5/2006 Allen ..... 362/294
2006/0220586 A1 * 10/2006 Latham ..... 315/185 S
2008/0012502 A1 * 1/2008 Lys ..... 315/247

FOREIGN PATENT DOCUMENTS

JP 2003347594 12/2003

* cited by examiner

*Primary Examiner*—David Hung Vu
*Assistant Examiner*—Tung X Le
(74) *Attorney, Agent, or Firm*—Cermak Kenealy Vaidya & Nakajima LLP

(57) ABSTRACT

A lighting lamp 1 using LED lamps as a light source can include a delay circuit 5, a power supply control unit 6, and a timer circuit 7. The delay circuit 5 can be configured to cause the luminous intensity of the LED lamps to rise along a predetermined slope upon turning on the lighting lamp. The power supply control unit and the timer circuit can be configured to cause the luminous intensity of the LED lamps to fall along a predetermined slope which has an inflection point P at a predetermined time point along the slope.

16 Claims, 5 Drawing Sheets

LIGHTING LAMP

This application claims the priority benefit under 35 U.S.C. §119 of Japanese Patent Application No. 2005-340309 filed on Nov. 25, 2005, which is hereby incorporated in its entirety by reference.

BACKGROUND

1. Field

The presently disclosed subject matter relates to a lighting lamp such as a lamp for a vehicle, and more particularly relates to a configuration of a lighting lamp employing at least one LED lamp used as a light source thereof.

2. Description of the Related Art

A conventional lighting lamp using a filament bulb as a light source uses a filament, and, when turned on, the temperature of the filament gradually increases as time elapses, and the lamp arrives at a predetermined brightness and becomes stable upon reaching a state where a prescribed current flows. This powering up state can be observed from the outside and presents a rise of brightness, which is extremely short, but is sensible.

Moreover, upon turning off the lighting lamp, the current to the filament, which is providing light via incandescence due to electricity that is present, is shut off, and thus the temperature of the filament gradually decreases, and the brightness also gradually falls. A comparison of the change in the illuminance upon turning on with that upon turning off reveals that since forced heating is carried out by the impressed current upon turning on, the rise seems faster, and, on the other hand, since the filament is spontaneously cooled upon turning off, the fall seems slower than the rise.

Recently, semiconductor light emitting elements such as LED lamps 93 shown in FIG. 6 have increasingly been employed as a light source for a lighting lamp 90 because, among other reasons, they do not require a disconnection of a filament, and have a semipermanent life, resulting in simpler maintenance. The LED lamp 93 turns on while emitting a prescribed quantity of light immediately after the impression of a power supply, and turns off completely immediately after the shut off of the power supply, which is different from the above-described filament bulb.

As a result, the LED lamp suddenly turns on and off as compared with a lamp that uses a filament bulb for a light source, which can give an unpleasant sensation to a driver of a following vehicle, and may not give a sense of high quality. Thus, there has been proposed a circuit provided with a control unit 91 and a drive device 92 including a drive unit 92*a* such as the electronic relay as shown in FIG. 6. Upon turning off the circuit, which especially tends to give an unpleasant sensation to observers, a duty ratio of the voltage impressed on the LED lamps 93 is gradually lowered to reproduce a turn-off state that is close to that of a filament bulb as shown in FIG. 7 (refer to Japanese Unexamined Patent Publication (Kokai) No. 2003-347594).

However, since the LED lamp does not provide light almost immediately upon turning off the power supply as described above, if the off-duty portion of the cycle becomes wider as compared with the on-duty portion of the cycle, flickering may be sensed more dominantly instead of the intended decrease of brightness. Thus, it may be necessary to rapidly turn off the LED lamp after the brightness decreases to a certain degree, which is far from an accurate or complete reproduction of the spontaneous turn-off characteristics of the filament bulb.

Furthermore, if a light emitting body which is configured to provide the complete flickering as described above is viewed in a lateral direction while the light emitting body is traveling at a relatively high speed, the light emitting states and extinct states may appear as a dotted line. Thus, the drive device 92 as described above may further increase the unpleasant sensation to an observer.

SUMMARY

To solve the above conventional problem and other problems and to achieve certain other characteristics in reproducing the turn-on or turn-off state of a filament bulb, in a first aspect of the presently disclosed subject matter, there is provided a lamp using LED lamps as a light source. The lamp can include a delay circuit that causes the luminous intensity of the LED lamps to rise along a predetermined slope up to a prescribed value upon turning on the lighting lamp.

According to another aspect of the presently disclosed subject matter, there is provided a lamp using LED lamps as a light source. The lamp can include a power supply control unit that carries out PWM control, and a delay circuit, where the power supply control unit and the delay circuit cause the luminous intensity of the LED lamps to fall along a predetermined slope down to the extinction upon turning off the lighting lamp.

According to the presently disclosed subject matter, the behavior of a filament bulb when it is turned on and/or off, namely, the linear change in the brightness as viewed by the human eyes, can be reproduced by LED lamps, thereby eliminating the unpleasant sensation felt by an observer, giving a sense of high quality, and ensuring a long life, resulting in advantages such as simplified maintenance, simplified structure of the lighting lamp, and a reduced cost.

DETAILED DESCRIPTION OF EXEMPLARY EMBODIMENTS

Figure 1:
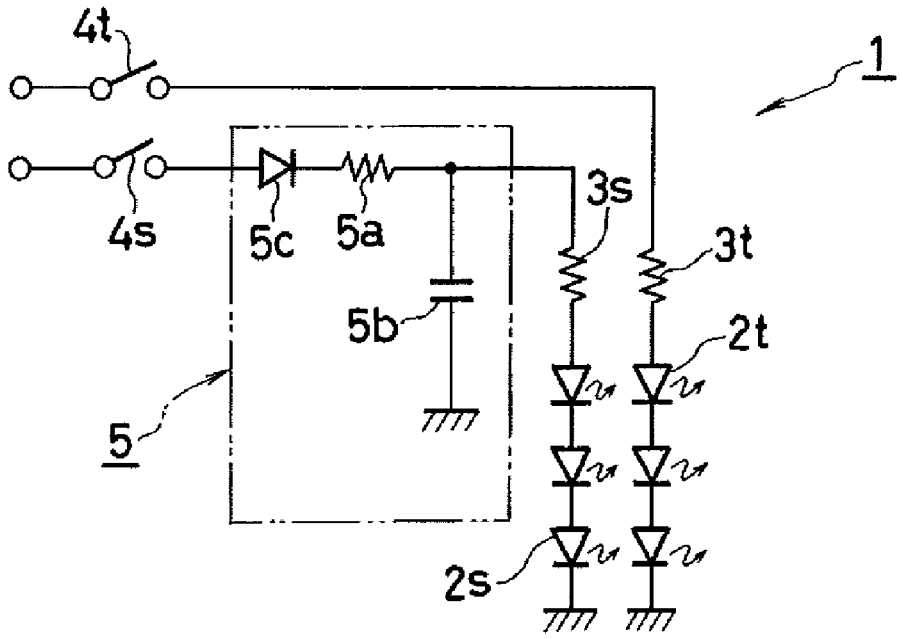
FIG. 1 is a circuit diagram showing an embodiment of a lighting lamp made in accordance with principles of the disclosed subject matter.

A description will now be given of exemplary embodiments of the disclosed subject matter with reference to drawings. FIG. 1 shows an example of a circuit that includes a delay circuit in order to make an incremental rise of light upon turning on LED lamps imitate that of a filament bulb.

Reference numeral 1 denotes a lighting lamp in FIG. 1, and a description will be given of an example of tail/stop lamps for vehicle lamps, for which, as this type of the lighting lamp 1, LED lamps are often employed as a light source. Moreover, tail LED lamps 2*t*, which can be permanently on when headlights are on during night travel, and stop LED lamps 2*s*, which are turned on and off according to operation of a brake, can be provided for the tail/stop lamps. A delay circuit 5 can be provided only for the stop LED lamps 2*s*, which are frequently turned on and off.

As shown in the example lamp of FIG. 1, a current limit resistor 3*t* is serially connected to the tail LED lamps 2*t* to provide proper illuminance for a tail lamp. Similarly, a current limit resistance 3*s* is connected to the stop LED lamps 2*s* to provide proper illuminance for a stop lamp. A switch 4*t* is provided for the tail LED lamps 2*t*, and a switch 4*s* is provided for the stop LED lamps 2*s*, thereby providing a circuit configuration for turning on/off the lamp.

According to the embodiment, in addition to the above-described basic configuration of the lighting lamp 1, a delay circuit 5 can be provided between the switch 4*s* and the stop LED lamps 2*s* including the current limit resistor 3*s*. The delay circuit 5 can include a resistor 5*a*, a capacitor 5*b*, and a diode 5*c*.

The resistor 5*a* and the capacitor 5*b* constitute an integration circuit, and when the switch 4*s* is turned on, the capacitor 5*b* is charged via the resistor 5*a*, and the voltage of the capacitor 5*b* increases to reach a power supply voltage. When the resistance (several Ω to 1KΩ, for example) of the resistor 5*a* and the capacitance (10 to 1000 μF, for example) of the capacitor 5*b* are properly set, the stop LED lamps 2*s* do not emit light at prescribed brightness immediately after turning on the switch 4*s*. Instead, the LED lamps 2*s* emit light such that the brightness gradually increases as indicated by waveform S in FIG. 2. It should be noted that light emitted from the tail LED lamps 2*t* that are configured as a tail lamp, the light being indicated by a waveform T, can be added when headlights are in operation or when otherwise desired.

Figure 2:
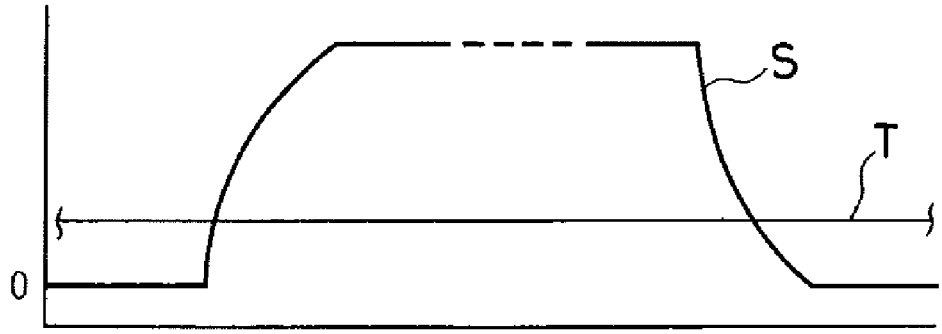
FIG. 2 is a chart showing an output waveform for the circuit shown in FIG. 1.

When the switch 4*s* is turned off, since the capacitor 5*b* is charged according to the capacitance thereof, the brightness gradually decreases upon turning off. Though this configuration can imitate the turn-on state of a filament bulb by impressing a voltage via the switch 4*s* to forcefully emit the light, it is difficult for the capacitance of the capacitor 5*b* to imitate the turn-off state brought about by the spontaneous cooling of a filament. It should be noted that the diode 5*c* serves to prevent a back current toward the power supply. The light emission varies from zero to its intended output along a continuous output line and at a predetermined slope, as shown in FIG. 2, that is dependent on the type of delay circuit 5 that is provided.

Figure 3:
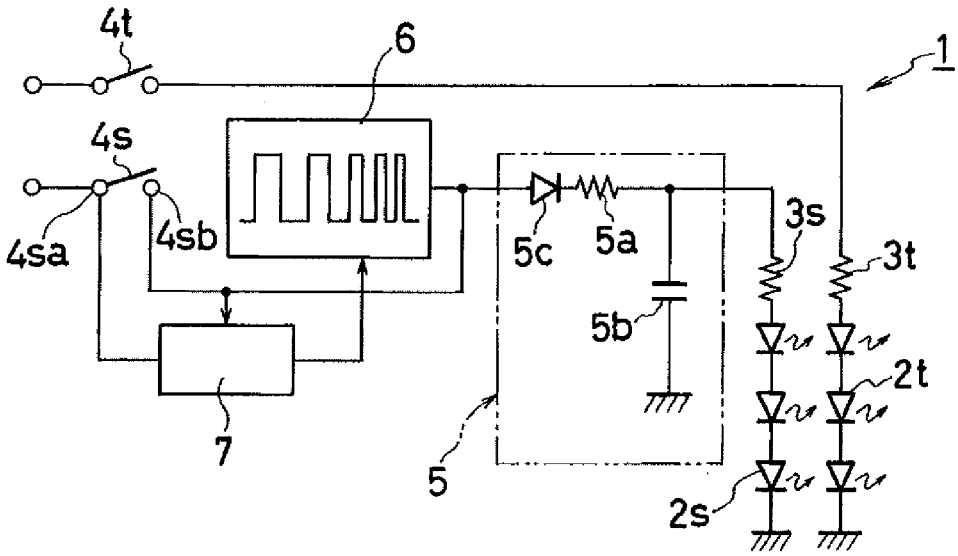
FIG. 3 is a circuit diagram showing another embodiment of a lighting lamp made in accordance with principles of the disclosed subject matter.

FIG. 3 shows another embodiment of the disclosed subject matter which includes a power supply control unit 6 and a timer circuit 7 in addition to the above-described delay circuit 5.

According to this embodiment, a contact 4*sb* on the opening side of the switch 4*s* for turning on/off the stop lamp (LED lamps 2*s*) is connected to the delay circuit 5 and the timer circuit 7, and is not directly connected to the power supply control unit 6. Thus, if the switch 4*s* is turned on, the stop lamp is turned on via the delay circuit 5.

If the switch 4*s* is turned off, the current is not basically supplied to the stop LED lamps 2*s*. However, contact 4*sa* on the power supply side of the switch 4*s* is connected to one end of the timer circuit 7, and if the contact 4*sb* goes to the "L" level, the timer circuit 7 becomes conductive for a certain period (120 ms to 200 ms, for example) and thus supplies electricity to the power supply control unit 6 for that period of time.

Figure 5:
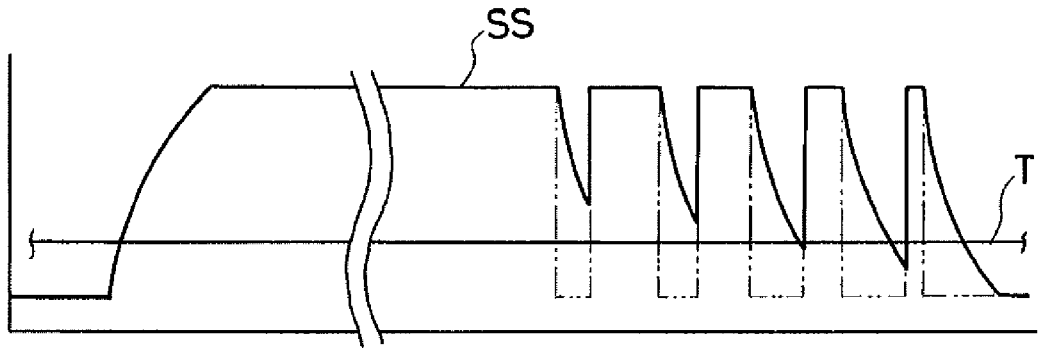
FIG. 5 is a chart showing a state of the output current from turn-on to turn-off for a lamp according to the embodiment of FIG. 3.
Figure 6:
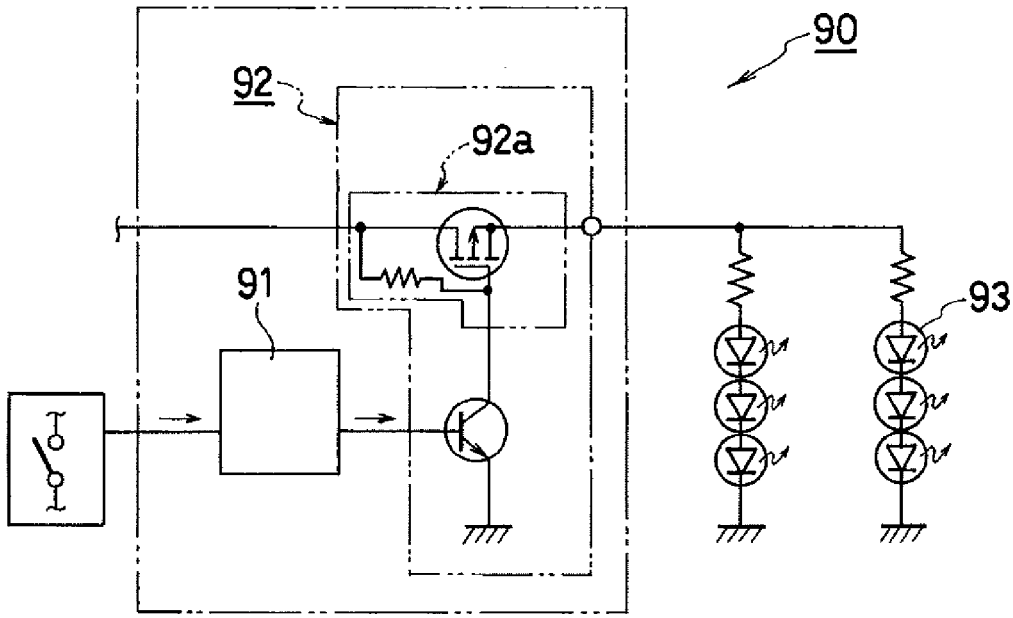
Fig. 6 Conventional Art
FIG. 6 is a circuit diagram of a conventional example.
Figure 7:
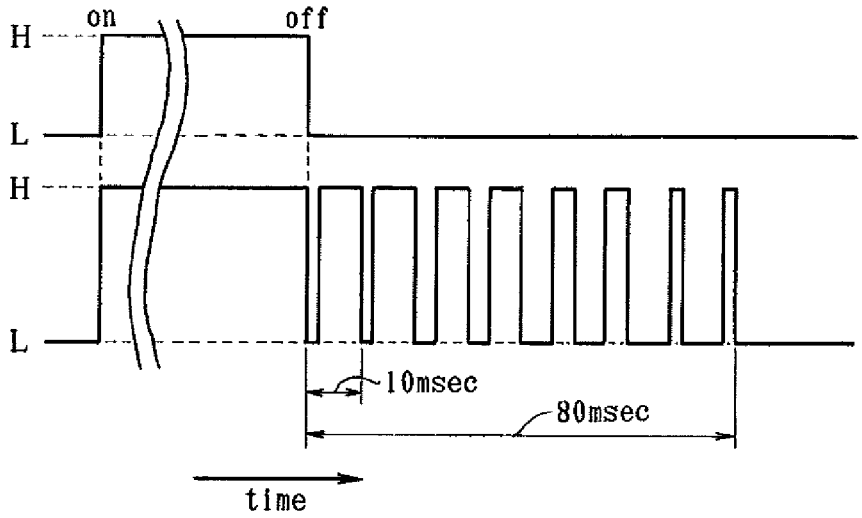
Fig. 7 Conventional Art
FIG. 7 is a chart showing an output waveform according to the conventional example of FIG. 6.

The power supply control unit 6 is configured to output, upon the supply of electricity, a PWM waveform whose duty ratio gradually decreases, and the PWM waveform is input to the delay circuit 5. Consequently, light whose brightness is more averaged is emitted to the outside as waveform SS as shown in FIG. 5. A driver of a following vehicle thus senses a gradual dimming of the light as if a stop lamp using a filament bulb as the light source were turned off, which does not cause an unpleasant sensation.

According to a result of experimentation, in order to reproduce the turn-off characteristics of a filament bulb, it was found that it may be helpful to carry out the dimming of the light according to a curve Q which has an inflection point P, at which the gradient of the decrease changes, at a predetermined position.

Figure 4:
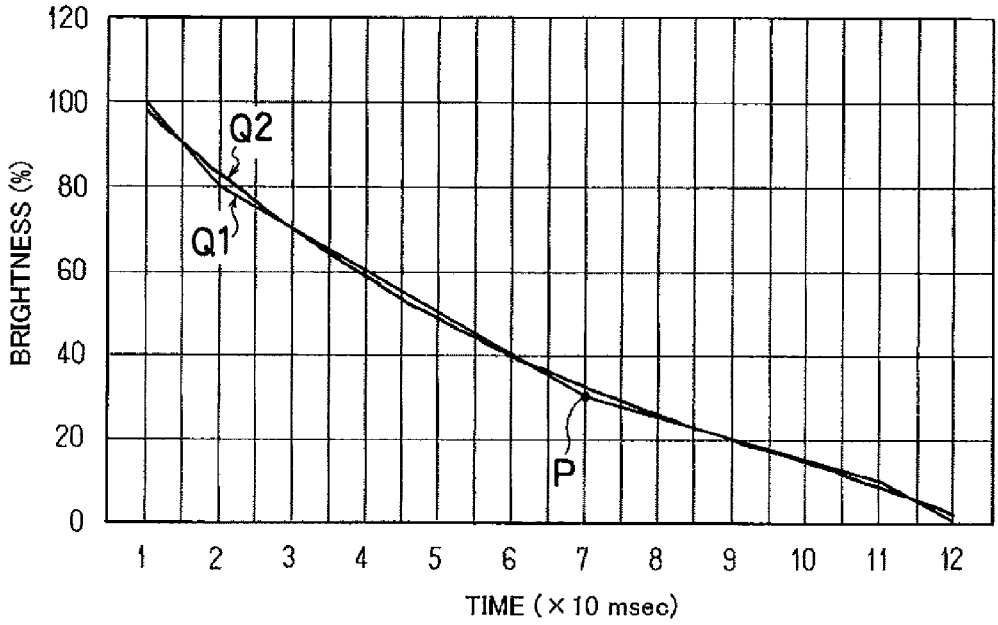
FIG. 4 is a chart showing a change of brightness with respect to a time axis upon turning off of the lamp of FIG. 3.

FIG. 4 is a chart showing such curves Q1 and Q2, for example. In FIG. 4, a curve denoted by Q1 is an actual measurement of the ratio of the dimming for which an observer feels is similar to the turn-off of a filament bulb, and is thus desirable for certain applications. A curve denoted by Q2 in FIG. 4 is a polynomial approximating the actual measurement (polynomial is presented as $y=-0.003X^4+0.0314X^3+0.07096X^2-17.297X+114.92$). Approximately the same effect is obtained by employing either of the curves, as shown in FIG. 4.

TABLE 1

| BRIGHTNESS (%) | TIME (×10 msec) |
|---|---|
| 100 | 1 |
| 80 | 2 |
| 70 | 3 |
| 60 | 4 |
| 50 | 5 |
| 40 | 6 |
| 30 | 7 |
| 25 | 8 |
| 20 | 9 |
| 15 | 10 |
| 10 | 11 |
| 1 | 12 |

Table 1 summarizes measurements and values calculated by means of the polynomial at an interval of 10 ms in order to obtain operating parameters for the power supply control unit 6 such that it can approximate the turn-off state of a filament bulb used as a light source of a stop lamp and the like. In this example, the brightness decreases by 10% for each 10 ms from 20 ms to 70 ms after the start of the turn-off period, except for the first 10 ms.

After 70 ms, the brightness decreases by 5% for each 10 ms, which is half of the previous ratio of the decrease, and this rate of decrease of the brightness is maintained until the extinction of the lamp. With reference again to FIG. 4, the ratio of the dimming apparently becomes gentle after a point at approximately 50 to 70% of the period from the start of the turn-off. If the first ratio is maintained in this portion until the end of the dimming, the quantity of light may be visually recognized as decreasing too rapidly, which does not imitate the intended impression of the turn-off of a filament bulb.

Thus, according to the disclosed subject matter, an inflection point P, at which the ratio of the dimming changes, is set to 60% of the period from the start to the end of the turn-off, resulting in more accurate reproduction of the state of the turn-off of the filament bulb. The heat capacity of a filament bulb varies according to the power consumption thereof, and the time period from the start to the end of the turn-off is thus preferably set to a realistic period, such as 120 ms on the timer 7 if a light source of a stop lamp is changed from a filament bulb to LED lamps.

The above description is given of an example where the delay circuit 5, the power supply control unit 6, and the timer circuit 7 are provided for a stop lamp, which is frequently turned on and off. However, the disclosed subject matter is not limited to application to this type of lamp, and may be provided also for tail lamps, signal lamps, traffic lamps, spot lamps, headlamps, house lamps, etc.

As described above, when a lighting lamp that uses LED lamps as a light source is configured according to the disclosed subject matter, the unpleasant sensation felt by a driver of a following vehicle due to the sudden turn-on or turn-off is eliminated by sensuously imitating the turn-on and turn-off characteristics of a lighting lamp that uses a conventional filament bulb as a light source.

Simultaneously, in order to realize dimming of the light along a slope that imitates the turn-off characteristic of a filament bulb, the appearance of the turn-off is reproduced without changing the impression of the turn-off state and loosing the sense of high quality, for example, by providing a turn-off period of 120 to 200 ms, which is similar to that of a filament bulb. A change in gradient at the point P can also be provided, resulting in an excellent effect in terms of the quality of a lighting lamp having LED lamps as a light source.

FIG. 5 schematically shows the turn-on state of a stop lamp. Upon turning on, the brightness increases gradually due to the delay circuit 5, resulting in a turn-on state similar to that of a filament bulb. Upon turning off, the power supply control circuit 6 reproduces the state of the turn-off of a filament bulb thereby reducing or eliminating the unpleasant sensation of an observer. Since the chopped current output from the power supply control circuit 6 passes through the delay circuit, the current which has passed both the circuits can have an inflection point P as shown in FIG. 4.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A lighting lamp comprising:

an LED lamp configured for use as a light source and which emits light having a luminous intensity characteristic when connected to an electrical power source;

a power supply control unit connected to the LED lamp and configured to carry out PWM control on an electrical signal provided by the power source; and a delay circuit connected to the LED lamp, wherein the power supply control unit and the delay circuit are configured to cause the luminous intensity of the LED lamp to fall along a predetermined slope down to extinction of the lighting lamp upon turning off the lighting lamp, wherein a period from the start of turning-off of the lighting lamp to extinction of the lighting lamp is greater than substantially 120 ms such that upon turning off the lighting lamp the lighting lamp reproduces behavior of a filament lamp when the filament lamp is turned off.

2. The lighting lamp according to claim 1, wherein the period from the start of turning-off of the lighting lamp to extinction of the lighting lamp is between substantially 120 ms and substantially 200 ms.

3. The lighting lamp of claim 2, wherein the lighting lamp is configured for use in a vehicle including a tail lamp and a stop lamp, and the power supply control unit and the delay circuit are configured to control the stop lamp.

4. The lighting lamp of claim 1, wherein the lighting lamp is configured for use in a vehicle including a tail lamp and a stop lamp, and the power supply control unit and the delay circuit are configured to control the stop lamp.

5. The lighting lamp of claim 1, further comprising:

a timer circuit connected to the power supply control unit.

6. A lighting lamp comprising:

an LED lamp configured for use as a light source and which emits light having a luminous intensity characteristic when connected to an electrical power source;

a power supply control unit connected to the LED lamp and configured to carry out PWM control on an electrical signal provided by the power source; and a delay circuit connected to the LED lamp, wherein the power supply control unit and the delay circuit are configured to cause the luminous intensity of the LED lamp to fall along a predetermined slope down to extinction of the lighting lamp upon turning off the lighting lamp, wherein the predetermined slope has an inflection point located between 50% to 70% of a period from the start of turning-off of the lighting lamp to extinction of the lighting lamp, and the gradient from the inflection point to the extinction of the lighting lamp is small with respect to the gradient from the start of the turning-off of the lighting lamp to the inflection point.

7. The lighting lamp according to claim 6, wherein the inflection point is at approximately 60% of the period from the start of turning-off of the lighting lamp to extinction of the lighting lamp.

8. The lighting lamp according to claim 7, wherein the period from the start of turning-off of the lighting lamp to extinction of the lighting lamp is between substantially 120 ms and substantially 200 ms.

9. The lighting lamp of claim 7, wherein the lighting lamp is configured for use in a vehicle including a tail lamp and a stop lamp, and the power supply control unit and the delay circuit are configured to control the stop lamp.

10. The lighting lamp according to claim 6, wherein the predetermined slope is configured so that the gradient from the inflection point to the extinction of the lighting lamp is approximately half the gradient from the start of turning-off of the lighting lamp to the inflection point.

11. The lighting lamp according to claim 10, wherein the period from the start of turning-off of the lighting lamp to extinction of the lighting lamp is between substantially 120 ms and substantially 200 ms.

12. The lighting lamp of claim 10, wherein the lighting lamp is configured for use in a vehicle including a tail lamp and a stop lamp, and the power supply control unit and the delay circuit are configured to control the stop lamp.

13. The lighting lamp according to claim 6, wherein the period from the start of turning-off of the lighting lamp to extinction of the lighting lamp is between substantially 120 ms and substantially 200 ms.

14. The lighting lamp of claim 6, wherein the lighting lamp is configured for use in a vehicle including a tail lamp and a stop lamp, and the power supply control unit and the delay circuit are configured to control the stop lamp.

15. A lighting lamp comprising:

an LED lamp configured for use as a light source and which emits light of a predetermined luminous intensity when subjected to a constant voltage;

a delay circuit connected to the LED lamp and configured to provide the constant voltage to the LED lamp after a predetermined amount of time lapses after turning the lighting lamp on, the delay circuit also configured to cause the luminous intensity of the LED lamp to rise along a continuously rising and predetermined gradual slope from zero when turning on the lighting lamp to the predetermined luminous intensity when the delay circuit provides the constant voltage to the LED lamp such that upon turning on the lighting lamp the lighting lamp reproduces lighting behavior of a filament lamp when the filament lamp is turned on; and a power supply control unit connected to the LED lamp and configured to carry out PWM control on an electrical signal, wherein the power supply control unit and the delay circuit are configured to cause the luminous intensity of the LED lamp to fall along a predetermined slope down to extinction of the lighting lamp upon turning off the lighting lamp, wherein the predetermined slope down has an inflection point located between 50% to 70% of a period from the start of turning-off of the lighting lamp to extinction of the lighting lamp, and the gradient from the inflection point to the extinction of the lighting lamp is small with respect to the gradient from the start of the turning-off of the lighting lamp to the inflection point.

16. The lighting lamp of claim 15, wherein the delay circuit includes a diode, a resistor, and a capacitor electrically connected to the LED lamp.

* * * * *